United States Patent [19]

Dougherty et al.

[11] Patent Number: 4,776,822

[45] Date of Patent: Oct. 11, 1988

[54] REGISTRATION TRANSFER PROCESS FOR USE IN THE MANUFACTURE OF A TENSION MASK COLOR CATHODE RAY TUBE

[75] Inventors: Lawrence W. Dougherty, Sleepy Hollow; James R. Fendley, Arlington Heights; James L. Kraner, Barrington, all of Ill.

[73] Assignee: Zenith Electronics Corporation, Glenview, Ill.

[21] Appl. No.: 119,765

[22] Filed: Nov. 12, 1987

[51] Int. Cl.[4] ..... H01J 9/227; H01J 9/26

[52] U.S. Cl. ..... 445/45; 29/423; 29/464; 430/23; 445/30; 445/52

[58] Field of Search ..... 445/45, 52, 30; 430/23; 29/423, 464, 281.1; 269/305, 908, 7

[56] References Cited

U.S. PATENT DOCUMENTS

| | | | |
|---|---|---|---|
| 2,916,644 | 12/1959 | Kautz et al. | 313/482 X |
| 3,787,937 | 1/1974 | Palac | 445/45 |
| 3,894,321 | 7/1975 | Moore | 445/30 |
| 3,904,914 | 9/1975 | Palac | 313/407 |
| 3,995,283 | 11/1976 | Dougherty et al. | 269/908 X |
| 4,100,451 | 7/1978 | Palac | 313/404 |
| 4,595,857 | 6/1986 | Rowe et al. | 313/407 |
| 4,621,797 | 11/1986 | Ziegenfuss | 269/305 |
| 4,713,034 | 12/1987 | Lee et al. | 445/45 |
| 4,721,488 | 1/1988 | Dougherty et al. | 445/30 |

*Primary Examiner*—Kenneth J. Ramsey

[57] ABSTRACT

A proceses is disclosed for use in the manufacture of a color cathode ray tube having a rectangular flat faceplate. The process comprises positioning the faceplate in a predetermined x-y plane by referencing faceplate a-b-c reference areas on two adjacent edges or sides of the faceplate with complementary a-b-c reference points on a faceplate locating fixture; the fixture also has three spaced six-point precision indexing means. With the faceplate a-b-c reference areas and the faceplate locating fixture a-b-c points mutually referenced, six-point precision indexing means are attached to the faceplate in registation with the precision indexing means on the faceplate locating fixture. Using the precision indexing means attached to the faceplate, a shadow mask is registered with the faceplate through the use of complementary precision indexing means to provide a faceplate-shadow mask assembly in mutual precise registry. Using the registered faceplate-shadow mask assembly, a pattern of phosphors is photodeposited on the faceplate by photoexposure means. The registry of the pattern of phosphors and the shadow mask is accomplished according to the invention with a precision made possible by the use of the six-point precision indexing means, and the location of the patterns on the faceplate is made possible by the use of the a-b-c referencing of the faceplate and the faceplate locating fixture.

13 Claims, 4 Drawing Sheets

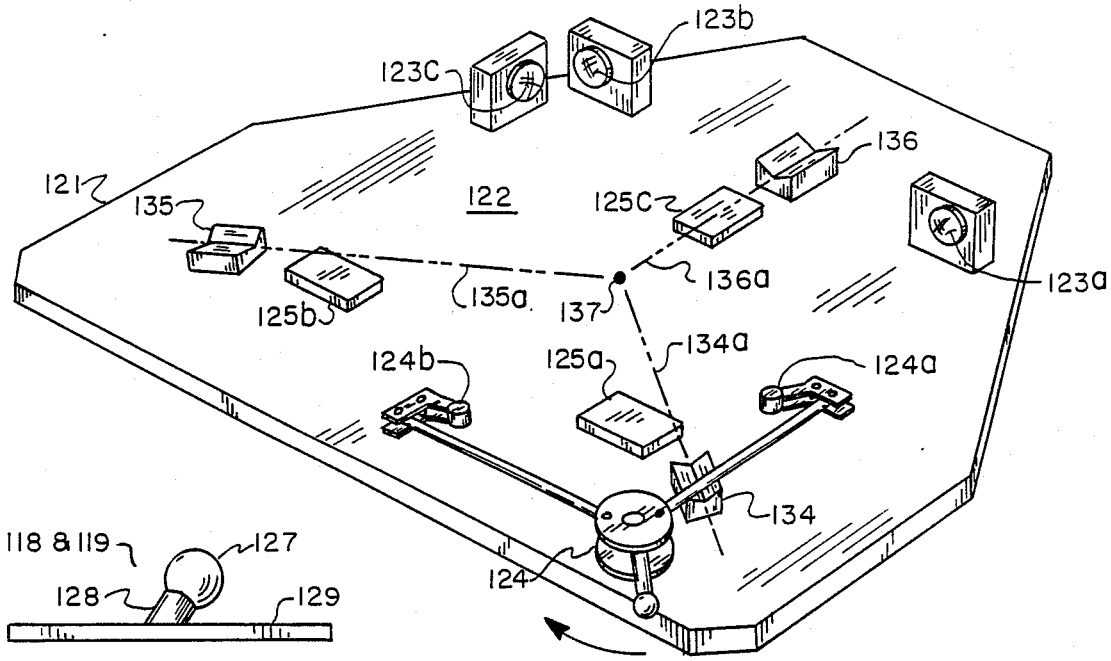
FIG. 4
FIG. 5
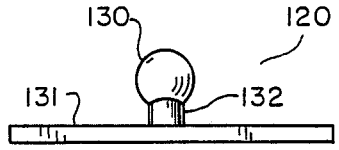
FIG. 6
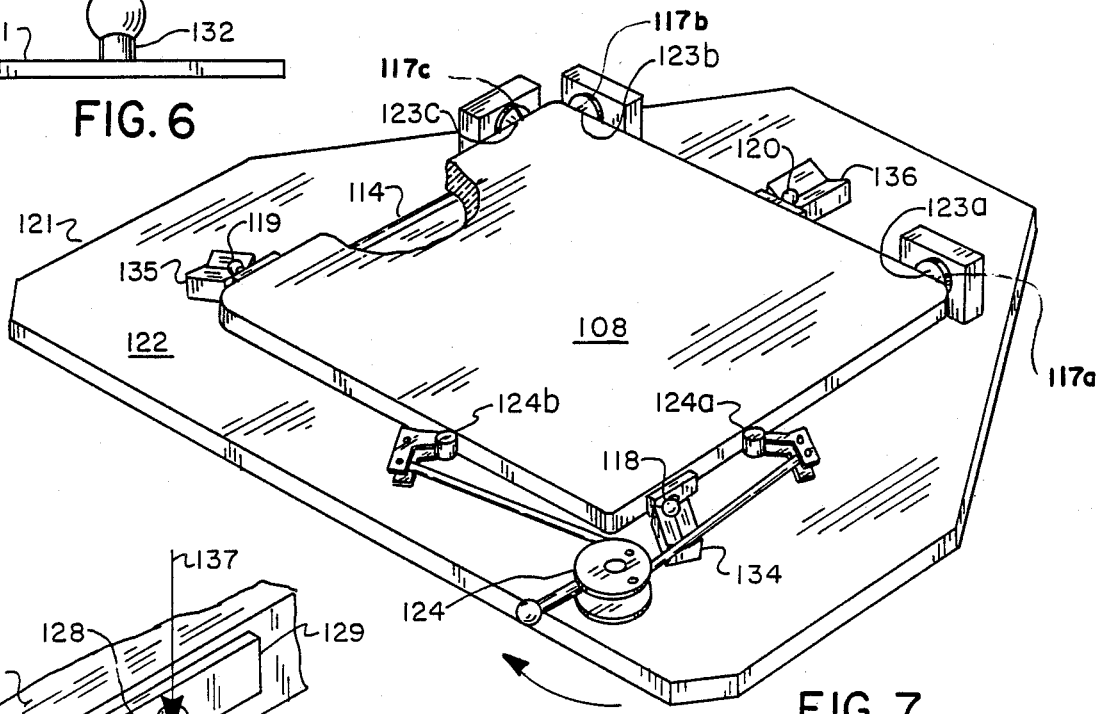
FIG. 7
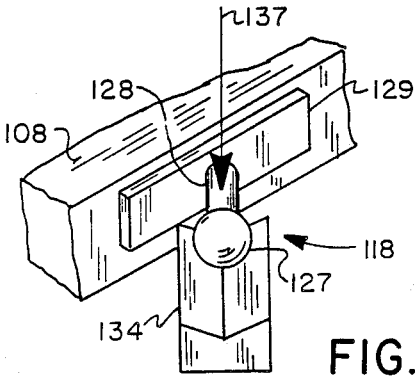
FIG. 8

REGISTRATION TRANSFER PROCESS FOR USE IN THE MANUFACTURE OF A TENSION MASK COLOR CATHODE RAY TUBE

CROSS-REFERENCE TO RELATED APPLICATIONS AND PATENTS

This application is related to but in no way dependent upon copending applications Ser. No. 538,001, now U.S. Pat. No. 4,593,224; Ser. No. 758,174, now U.S. Pat. No. 4,713,034; Ser. No. 832,556, now U.S. Pat. No. 4,721,488; Ser. No. 058,095 filed June 4, 1987; Ser. No. 051,896 filed May 18, 1987; Ser. No. 060,135 filed June 9, 1987; Ser. No. 060,142 filed June 9, 1987; and U.S. Pat. Nos. 3,889,321; 3,894,321; 4,069,567; 4,100,541; 4,547,696; 4,591,344; 4,593,224; 4,593,225; 4,595,857; 4,614,892; 4,652,791; 4,656,388; 4,672,260; 4,678,447; 4,686,416; and 4,692,660, all of common ownership herewith.

This specification includes an account of the background of the invention, a description of the best mode presently contemplated for carrying out the invention, and appended claims.

BACKGROUND OF THE INVENTION

1. Field of the Invention

This invention relates to color cathode ray picture tubes, and is addressed specifically to an improved process for the manufacture of tubes having a tensed foil shadow mask. Color tubes of various types that have a tension foil mask can be manufactured by the process, including those used in home entertainment television receivers. The process according to the invention is particularly valuable in the manufacture of medium-resolution, high-resolution, and ultra-high resolution tubes intended for color monitors.

The use of the foil-type flat tension mask and flat faceplate provides significant benefits in comparison to the conventional domed shadow mask and correlatively curved faceplate. Chief among these is a greater power-handling ability which makes possible as much as a three-fold in-crease in brightness. The conventional curved shadow mask, which is not under tension, tends to "dome" in picture areas of high brightness where the intensity of the electron beam bombardment is greatest. Color impurities result as the mask moves closer to the faceplate and as the beam-passing apertures move out of registration with their associated phosphor elements on the faceplate. When heated, the tensed mask distorts in a manner quite different from the conventional mask. If the entire mask is heated uniformly, there is no doming and no distortion until tension is completely lost; just before that point, wrinkling may occur in the corners. If only portions of the mask are heated, those portions expand, and the unheated portions contract, resulting in displacements within the plane of the mask; i.e., the mask remains flat.

The tensed foil shadow mask is a part of the cathode ray tube faceplate assembly, and is located in close adjacency to the faceplate. The faceplate assembly comprises the faceplate with its screen, which consists of deposits of light-emitting phosphors, a shadow mask, and support means for the mask. As used herein, the term "shadow mask" means an apertured metallic foil which may, by way of example, be about 0.001 inch or less in thickness. The mask must be supported under high tension a predetermined distance from the inner surface of the cathode ray tube faceplate; this distance is known as the "Q-distance." As is well known in the art, the shadow mask acts as a color-selection electrode, or "parallax barrier," that ensures that each of the three electron beams lands only on its assigned phosphor elements.

The conventional process of depositing patterns of color phosphor elements on the screening surface of a color picture tube faceplate utilizes the well-known photoscreening process. A shadow mask, which in effect functions as a perforated optical stencil, is used in conjunction with a light source to expose in successive steps, at least three light-sensitive photoresist patterns on the screening surface. The shadow mask is typically "mated" to each faceplate; that is, the same mask is used in the production of a specific tube throughout the production process, and is permanently installed in the tube in final assembly. Typically, four engagements and four disengagements of the mask, as well as six exposures, are required in the standard photoscreening process. In certain of the processes, a "master" may be used for exposing the photo-resist patterns in lieu of a shadow mask permanently mated to the faceplate and its screen.

2. Prior Art

Kautz et al in U.S. Pat. No. 2,916,644 discloses a face panel assembly adapted to cooperate with a photoexposure device used in forming the screen. In one aspect of Kautz et al, spaced tabs are welded on or otherwise attached to the flange, or apron, of a curved face panel, and may extend either inwardly or outwardly. The tabs have apertures for cooperating with referencing means on the exposure table. An aligning device comprises a number of spheres each positioned in a groove. The means of aligning according to Kautz et al also provides for aligning a face panel assembly, a shield, and a funnel with one another in the finished tube.

U.S. Pat. No. 3,894,321 to Moore, of common ownership herewith, is directed to a method of producing a color cathode ray tube having a a funnel section, a foil shadow mask attached to a support, and a faceplate for receiving deposits of light-emitting phosphors. The foil is stretched across a supporting frame, and the faceplate and frame are aligned on an exposure table for photoscreening of the faceplate. The exposure table is tilted and the components are positioned by contact with alignment posts, and held there by gravity during the photoscreening process.

U.S. Pat. No. 4,100,451 to Palac, which is assigned to the assignee of the present invention, describes a system for suspending a domed non-self-rigid shadow mask a predetermined distance from a faceplate. Four suspension means provide for coupling and indexing the mask directly to corner portions of the faceplate. In one embodiment, the indexing means comprise legs having rounded portions which engage indexing cavities in the faceplate which may be in the form of V-grooves or slots. Another approach utilizes V-blocks at the four corners of the faceplate, each of which has a clamp attached to the mask. Each clamp has a foot for mating with a V-block. The suspension and indexing means provide for the permanent mounting of the shadow mask in relation to the faceplate, as well as for the temporary mounting of the mask during the production screening process.

External referencing means for a tube having a tensed foil mask is described and claimed in referent U.S. Pat. No. 4,595,857, of common ownership herewith. The referencing means provide for the precise faceplate-mask registration. The faceplate is equipped with three externally mounted, outwardly directed, breakaway pins. Indexing means cooperating with each of the pins comprises a breakaway tab affixed to a frame member which supports the shadow mask. Each tab has a depending finger which is provided with a bifurcation at its distal end. To effect registration, the faceplate is located so that the finger bifurcations are poised over the assigned pins. When the assembly is mated, a six-point contact is established between the three pins and their cooperating bifurcations. This registration is repeatable as often as is required to accomplish the screening process, as well as to effect a final registration between the electrode assembly and the faceplate during frit sealing. After frit sealing, the pins and tabs are removable; that is, they can be broken away.

In U.S. Pat. No. 4,713,034 to Lee et al., of common ownership herewith, there are disclosed components-in process and assemblies-in-process for use in the manufacture of a high-resolution color cathode ray tube having a tensed foil shadow mask. A first component-in-process comprises a faceplate with a target area for receiving at least one pattern of phosphor deposits. The faceplate has attached at preselected, widely spaced locations on the sides thereof a plurality of discrete, detachable first indexing elements. A second component-in-process comprises a shadow mask support assembly having a frame ultimately constituting a part of the tube envelope; the frame supports the shadow mask in precise adjacency to the target area. The frame has attached on the sides thereof a like plurality of discrete, detachable second indexing elements which are in facing adjacency to the first indexing elements on the faceplate when the faceplate and frame are mated. Temporary attachment of the indexing elements is by means of a thermally degradable cement. The faceplate and frame can be inter-registered in precise relationship by the temporary use of the first and second indexing elements in the process of screening the pattern of phosphor deposits on the target area and later in the final assembly of the tube.

OBJECTS OF THE INVENTION

It is a general object of this invention to provide an improved process for use in the manufacture of color cathode ray tubes having a tensed foil shadow mask.

It is an object of this invention to provide an improved process for ensuring proper registration of a foil shadow mask with the screening surface of a flat faceplate during manufacture of a color cathode ray tube having a tensed foil mask.

It is a further object of the invention to provide a process for establishing and maintaining proper Q-distance between a phosphor screening surface and a tensed foil shadow mask.

It is another object of the invention to provide a process for ensuring precise registration of the pattern of phosphors on the faceplate, the shadow mask, and the funnel of a tension mask color cathode ray tube.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompany-ing drawings (not to scale), in the several figures of which like reference numerals identify like elements, and in which:

FIG. 4 is a perspective view of a faceplate locating fixture for use in preparing a faceplate in the process according to the invention;

FIGS. 5 and 6 are detail views in elevation of two configurations of precision six-point indexing means comprising ball-plate indexing means for temporary attachment to the sides or edges of an in-process faceplate;

FIG. 7 is view similar to that of FIG. 4 but with an in-process faceplate indicated as being mounted on the fixture; the faceplate is partially cut away to indicate the location of a shadow mask support structure;

FIG. 8 is a detail view in perspective depicting a ball-plate indexing means shown by FIG. 5 in relation to the faceplate to which it is attached according to the invention;

DESCRIPTION OF THE PREFERRED EMBODIMENT

To facilitate understanding of the process according to the invention and its relation to the manufacture of a color cathode ray tube having a tensed foil shadow mask, a brief description of a tube of this type and its components is offered in following paragraphs.

Figure 1:
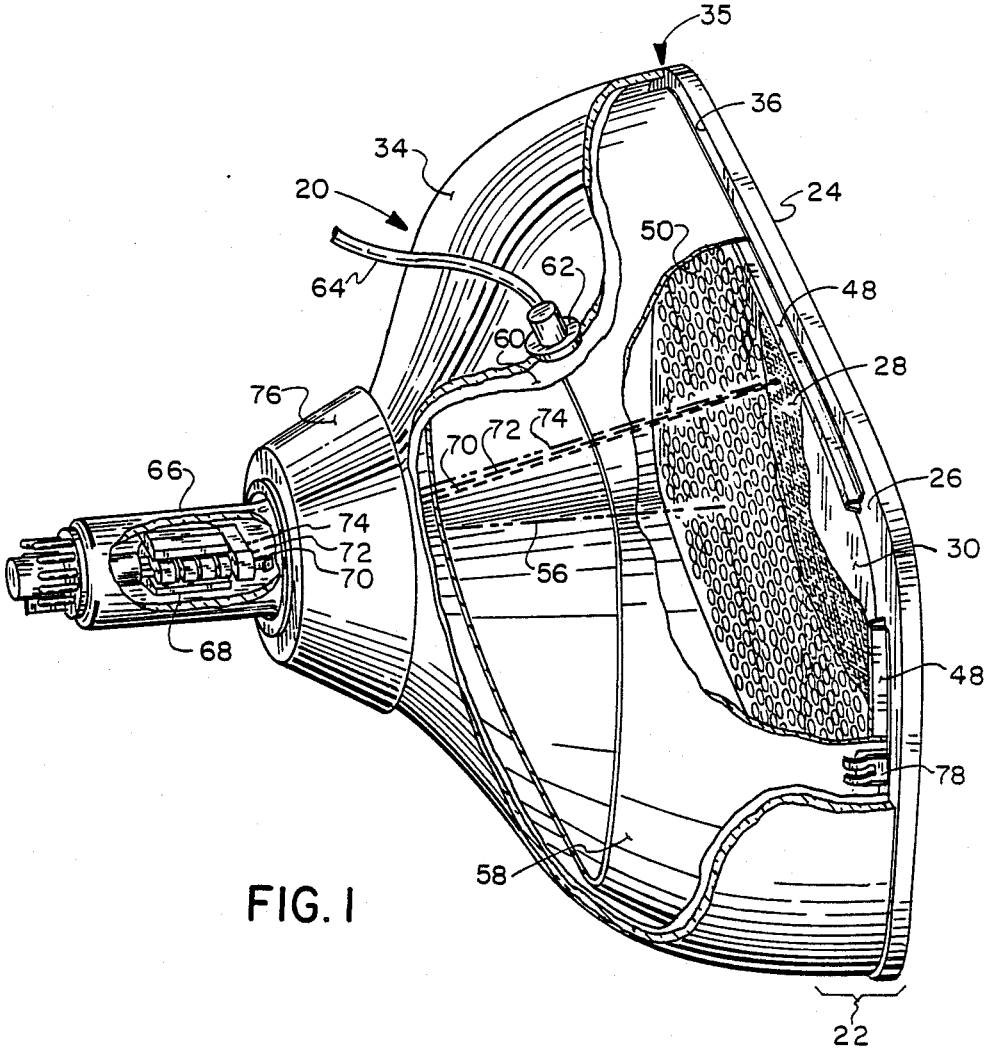
FIG. 1 is a side view in perspective of a color cathode ray tube having a flat faceplate and a tensed foil shadow mask, with cut-away sections that indicate the location and relation of the faceplate and shadow mask to other major tube components.

A color cathode ray tube 20 having a tensed foil shadow mask is depicted in FIG. 1. The faceplate assembly 22 of tube 20 includes a rectangular, flat glass faceplate 24 having on its inner surface 26 a centrally located phosphor screening area 28 indicated as having a pattern of phosphors thereon. A film of aluminum 30 is indicated as covering the pattern of phosphors. A funnel 34 is represented as being attached to faceplate assembly 22 at their interfaces 35; the funnel sealing surface 36 of faceplate 24 is indicated as being peripheral to screening area 28. A frame-like shadow mask support structure 48 is indicated as being located between funnel sealing surface 36 and screening area 28. Support structure 48 provides a surface for receiving and mounting in tension a metal foil shadow mask 50 a Q-distance away from the screening area 28. The pattern of phosphors corresponds to the pattern of apertures in mask 50.

The anterior-posterior axis of tube 20 is indicated by reference number 56. A magnetic shield 58 is shown as being enclosed within funnel 34. High voltage for tube operation is indicated as being applied to a conductive coating 60 on the inner surface of funnel 34 by way of an anode button 62 connected in turn to a high-voltage conductor 64.

The neck 66 of tube 20 is represented as enclosing an in-line electron gun 68 depicted as providing three discrete in-line electron beams 70, 72 and 74 for exciting respective red-light-emitting, green-light-emitting, and blue-light-emitting phosphor elements on screen 28. Yoke 76 receives scanning signals and provides for the scanning of beams 70, 72 and 74 across screen 28. An electrical conductor 78 is located in an opening in shield 58 and is in contact with conductive coating 60 to provide a high-voltage connection between the coating 60, the screen 28, and shadow mask 50. This means of electrical conduction is described and claimed in referent copending application Ser. No. 060,142 of common ownership herewith.

Two of the major components which the inventive method directly concerns, and noted as being "in-process," are depicted and described as follows. One is a shadow mask depicted diagrammatically in FIG. 2. In-process shadow mask 86 includes a center field 104 of apertures corresponding to the pattern of phosphors photodeposited on the screening area of the faceplate by means of the mask. Center field 104 is indicated as being surrounded by an unperforated section 106, the periphery of which is engaged during the mask tensing and clamping process, and which is removed in a later procedure, as will be described.

Figure 3:
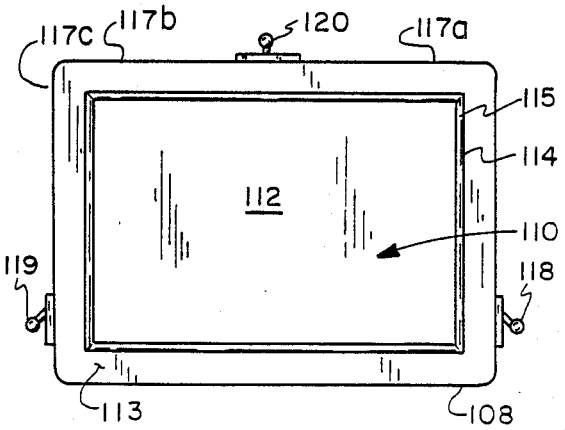
FIG. 3 is a plan view of an in-process flat glass faceplate showing a phosphor screening area and a foil shadow mask support structure secured thereto.

An in-process faceplate 108 is depicted diagrammatically in FIG. 3 as having on its inner surface 110 a centrally located screening area 112 for receiving a predetermined phosphor pattern in an ensuing operation. A funnel sealing surface 113 is peripheral to screening area 112. A frame-like shadow mask support structure 114 is depicted as being secured on opposed sides of screening area 112; the structure provides a surface 115 for receiving and mounting a foil shadow mask under tension a Q-distance from the screening area. Faceplate 108 is noted as having a-b-c reference areas; numbered respectively 117*a*, 117*b* and 117*c* located on two adjacent edges or sides of the faceplate 108, as indicated in FIG. 3. Also, faceplate 108 is depicted as having attached thereto temporary precision indexing ball-plate indexing means 118, 119 and 120 which comprise precision six-point indexing means according to the invention, as will be described.

The faceplate is positioned in a predetermined x-y plane according to the inventive process by referencing the faceplate a-b-c reference areas 117*a*, 117*b* and 117*c*, indicated as being located on two adjacent edges or sides of the faceplate, with complementary a-b-c reference points on a faceplate locating fixture.

A faceplate locating fixture such as that depicted by way of example in FIG. 4 may be used to implement the inventive method. Faceplate locating fixture 121 is indicated as comprising a table 122 which is preferably as flat as a machinist's surface plate, and which forms an x-y plane. Table 122 of faeplate locating fixture 121 is shown as having mounted thereon three a-b-c reference points 123*a*, 123*b* and 123*c*. Faceplate locating fixture 121 is also depicted as having a manually releasable clamping means 124 with associated bumpers 124A and 124B for making contact with the edges of faceplate 108 and, as will be shown and described, for holding reference areas 117*a*, 117*b* and 117*c* of faceplate 108 firmly against reference points 123*a*, 123*b* and 123*c* of faceplate locating fixture 121. Clamping is accomplished by moving the lever depicted as extending from clamping means 124 in the direction of the associated arrow. Table 122 is also shown as having three rest pads 125A, 125B and 125C mounted thereon for receiving and supporting mask support structure 114 during the adhering of ball-plate indexing means to the edges of the faceplate during an an ensuing process.

Faceplate locating fixture 121 is also indicated as having three spaced six-point precision indexing means 134, 135 and 136, each indicated by way of example as comprising a block with groove means therein.

The purpose of faceplate locating fixture 121 is the mounting on the edges or sides of faceplate 108 temporary precision indexing ball-plate indexing means 118 and 119, and 120, with each noted as comprising precision six-point indexing means in the form of a ball.

Details of the the configuration of the ball-plate indexing means are depicted in FIGS. 5 and 6. Ball-plate indexing means 118 and 119 shown by FIG. 5 are indicated as having a slanted configuration in which the ball element 127 of ball-plate indexing means 118 and 119 is indicated at being mounted on an angled pedestal 128 attached to a plate 129. Two of the configuration depicted in FIG. 5 are used, and they are interchangeable between opposite sides. The ball element 130 of the ball-plate indexing means 120 depicted in FIG. 6 is shown as being mounted on a plate 131 by means of a pedestal 132 that extends in a direction normal to the side of faceplate 108. The respective plates 129 and 131 provide for attachment of the ball-plate indexing means 118, 119 and 120 to the sides of the faceplate 108, preferably at 120 degree intervals.

With reference now to FIG. 7, there is depicted the in-process faceplate 108 of FIG. 3 as mounted on faceplate locating fixture 121, with the a-b-c reference areas 117*a*, 117*b* and 117*c* of faceplate 108, and faceplate locating fixture a-b-c reference points 123*a*, 123*b* and 123*c*, indicated as being mutually referenced. Faceplate 108 is indicated as being held firmly in place on the flat surface of table 122 of faceplate locating fixture 121 by the clamping means 124, depicted as being in the clamping position by the manual rotation of the associated handle indicated by the arrow. The mounting surface 115 of shadow mask support structure 114 (see FIG. 3) is in firm contact with rest pads 125A, 125B and 125C (shown by FIG. 4) so that the proper distance is established and maintained between the inner surface of faceplate 108 and the mask-receiving surface 115 of the mask support 114 during ensuing steps in the inventive process.

The three ball-plate indexing means 118, 119 and 120 are precisely mounted on the edges or sides of faceplate 108 by means of the three spaced precision six-point indexing means 134, 135 and 136, indicated as comprising groove means. Although the ball means are shown as being attached to the faceplate, either the ball means or the groove means may be so attached, with the complementary means attached to the faceplate locating fixture.

The means of temporary attachment is by the application of a thermally degradable adhesive means preferably comprising a methacrylic adhesive which may be used in combination with an activator. A suitable adhesive for this purpose is supplied by Dymax Engineering Adhesive Co. of Torrington, Conn. under the designation "Dymax Multi-Cure 602-VT Adhesive." The activator preferably comprises a butyraldehyde condensation product which may be "Dymax Activator 535." Adhesive and activator media supplied by other manufacturers may as well be used provided that the quality and application criteria are met. FIG. 8 is a detail view of ball-plate means 118, with the ball 127 in the groove of six-point indexing means 134, and with the plate 129 in contact with the side of faceplate 108. In the process according to the invention, adhesive activator is applied by means of a brush to the side of faceplate 108 in the area which the "sole" of plate 129 of ball-plate indexing means 118 will contact. The adhesive may be applied by means of a plastic syringe, by way of example. Ball-plate indexing means 118 is then placed in the V-groove of spaced precision indexing means 134 where it may be retained by clamp means indicated schematically by arrow 137. Plate 129 is then pressed gently against the side of faceplate 108 and into contact with the activator. The adhesive becomes adherent almost immediately by the action of the activator, and ball-plate indexing means 118 is retained firmly in position. The procedure is repeated for the attachment of ball-plate means 119 and 120. Upon completion of the initial attachment of the three ball-plate means, faceplate 108 is then moved to a source of ultraviolet light for exposure of the areas of contact to the hardening influence of the radiation. After an exposure of about 90 seconds, with the duration depending upon the intensity of the radiation, the adhesive is firmly set, and the faceplate 108 is removed from locating fixture 121, ready for the photo-screening process.

Because of the precision required in the high-resolution screening of faceplate, frequent checking of the accuracy of installation of the ball-plate indexing means on the faceplates during manufacture is recommended to verify that the dimensional parameters are correct. For example, the accuracy of the attachment of the ball-plate indexing means to every panel is preferably checked by means of a precision gaging fixture, and the gaging fixture in turn is checked daily against a master gage.

The ball-and-groove indexing means described provide accurate registration by virtue of the six-point contact of the balls with the grooves. The V-grooves of precision six-point indexing means 134, 135 and 136, due to the orientation of each groove with the center of the panel, provide compensation for the inevitable variation in the dimensions and shape of individual panels due to imperfections in the panel manufacturing process, and thermal expansion and contraction effects during production. Such variations have no effect on proper registration, for the ball-plate means are custom-fitted to each panel by the inventive means and process. For example, a panel of larger than normal size will be accommodated because the balls are fitted into the three grooves of six-point precision indexing means 134, 135 and 136, the center lines 134A, 135A and 136A of which intersect at the center 137 of the faceplate locating fixture 121 (and hence the center of the faceplate 108); thus the balls in the case of a larger panel lie farther out in the grooves than would be the case with a smaller panel. In short, the center of a panel remains constant regardless of any size variations or changes in dimensions due to thermal effects. The exact registration established by the faceplate locating fixture 121 is maintained throughout the subsequent manufacturing process.

The six-point indexing means are depicted by way of example as comprising ball-and-groove means. Although ball-and-groove means are indicated as the means of indexing in this and in subsequent depictions, it is noted that other means of indexing may as well be used provided the means provide the necessary precision. Groove means of the present disclosure preferably comprise the improved means set forth in referent U.S. Pat. No. 4,692,660, of common ownership herewith; that is, the indexing means according to the referent patent are characterized by grooves each having a subtended angle in the range of 34 to 75 degrees, and preferably 53 degrees. The advantages of the cited angles in indexing components of the tension mask tube are fully set forth in the patent.

Figure 9:
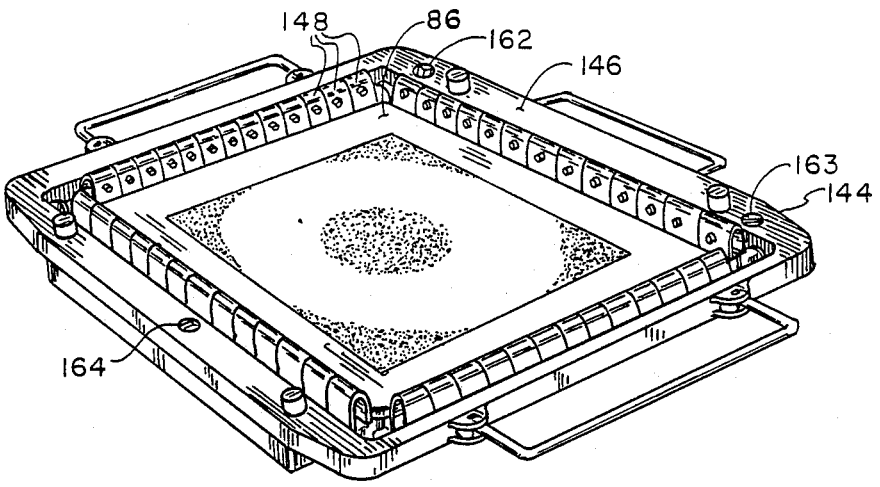
FIG. 9 is an oblique view in perspective of a production fixture with an in-process shadow mask indicated as being mounted in tension therein.

The ball-plate indexing means 118, 119 and 120, which comprise precision six-point indexing means according to the invention, are used for photodepositing the patterns of phosphors on faceplate 108. A preferred means for mating the faceplate 108 and the precision indexing means with a photoscreening lighthouse is by means of a frame-like production fixture having precision indexing means for registering with the ball-plate indexing means 118, 119 and 120 attached to faceplate 108. A production fixture suitable for the process according to the invention is depicted in FIG. 9. This fixture and its applications is fully described and claimed in referent copending application Ser. No. 051,896, of common ownership herewith. A production fixture having a configuration different from that shown and described in the following may as well be used, as the implementation of the present invention is not dependent upon this particular frame. However, any substitute must be able to provide the high precision and versatility required in the manufacture of tension mask cathode ray tubes.

Production fixture 144 has a number of six-point precision indexing means that provide for high precision in the registration and re-registration of an in-process foil shadow mask with a faceplate, and registration of the combination of both with production machinery during manufacture. A first side 146 of production fixture 144 is depicted FIG. 9. As indicated, the reusable production fixture 144 comprises a generally rectangular frame means and quick-release mechanical mask-retaining means for mounting and expanding an in-process foil shadow mask 108, with the mask in contact with the mask support structure 114 on faceplate 108, and in mutual precise registry with the screening area 112 of faceplate 108, using the precision indexing means on the faceplate and the fixture. The mask is supported in tension by means of mechanical mask-retaining means, shown as being in the form of a series of discrete spring clip means 148. The spring clip means of mask tensing and clamping is described and claimed in referent copending application Ser. No. 140,019 of common ownership herewith. Essentially, the production fixture 144 provides for the cementless and weldless quick-retention of an in-process shadow mask out of the plane of the mask, whereinafter the faceplate-shadow mask assembly is installed in precise relationship with production machinery such as a photoexposure lighthouse, and machinery for welding the shadow mask to the support structure extending from the faceplate and for severing the mask from the production fixture.

Figure 10:
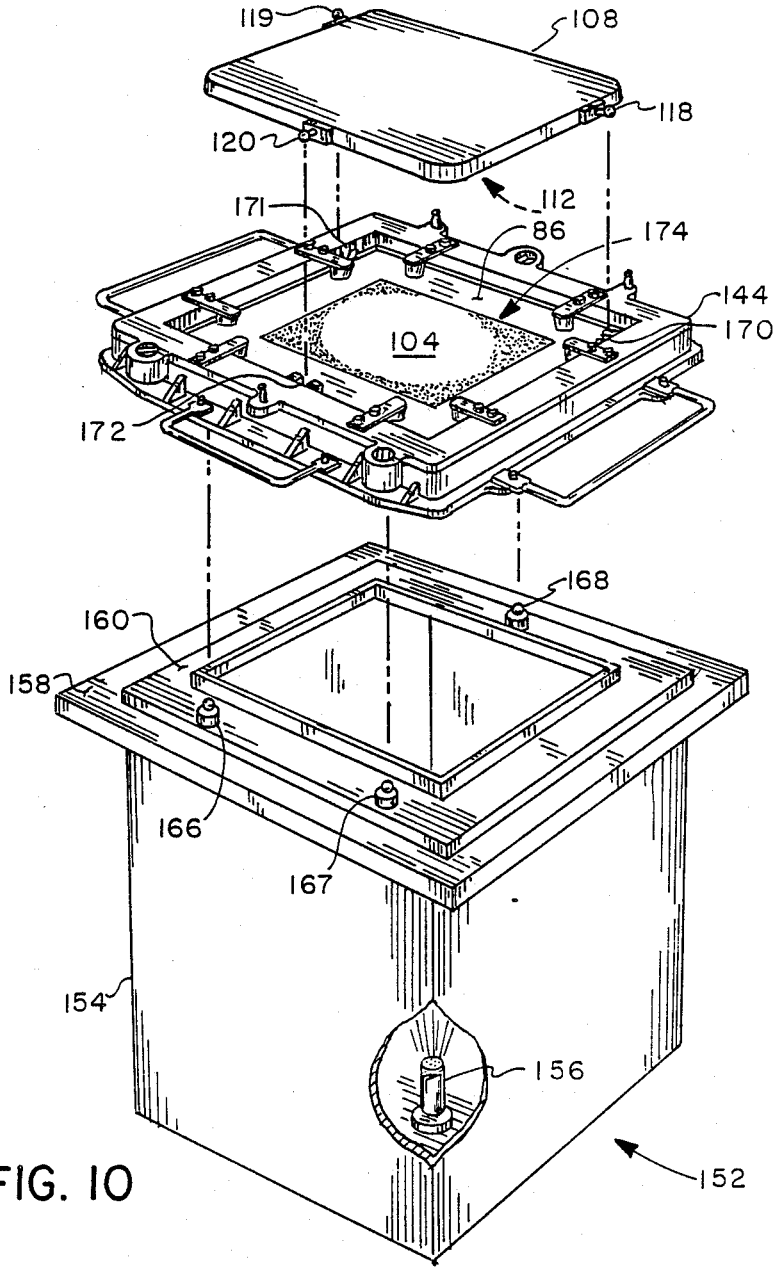
FIG. 10 is a perspective view of a photoexposure lighthouse used in the photoscreening process, with the base partly cut away to show internal details, and with a production fixture and an in-process faceplate indicated as being exploded therefrom in preparation for installation on the lighthouse table.

As indicated diagrammatically in FIG. 10, the faceplate 108 is lowered into the recess 174 in production fixture 144 such that the pattern of apertures 104 of the underlying in-process shadow mask 86 is in precise registration with the screening area 112 of faceplate 108. Lighthouse 152 is illustrated diagrammatically in FIG. 10 as comprising a base 154 within which is a light source 156 that emits ultraviolet radiation to which the various screening fluids used in the faceplate photoscreening process are sensitized. The rays of the light source 156 typically pass through a correction lens and a neutral density filter (not shown) before reaching the shadow mask and the screening area of the faceplate. A table top 158 provides for mounting a platform 160 for receiving production fixture 144.

Faceplate 108 is mated with production fixture 144, noted as holding shadow mask 104 in tension, by means of complementary six-point precision indexing means 170, 171 and 172 on fixture 144, indicated as comprising groove means, in registry with precision indexing means 118, 119 and 120, noted as being removably attached to the edges or sides of faceplate 108. With reference to the side 146 of production fixture 144 depicted in FIG. 9, three groove means 162, 163 and 164 are indicated which provide for registration with three ball means 166, 167 and 168 located on mounting platform 160 of lighthouse 152. As indicated by FIG. 10, the production fixture 144 is inverted from its FIG. 9 orientation, and lowered into registration with the lighthouse 152 for exposing the screening area 112 of in-process faceplate 108 to radiation from light source 156.

At least one pattern of phosphors is photodeposited on faceplate 108 by photoexposure means, using the lighthouse depicted in FIG. 10. For color cathode ray tubes, a "grille" or black surround is normally deposited first, followed by the sequential deposition of three colored-light-emitting phosphors. Prior to the installation of faceplate 108 in production fixture 144, a coating of a light-sensitive grille material is applied to the screening area 112 of in-process faceplate 108. The production fixture 144, with the in-process shadow mask 108 mounted in tension therein, is installed on the mounting platform 160 of lighthouse 152. The screening area 112 of faceplate 108 is exposed to light actinic to the coating through the predetermined pattern of apertures in the in-process shadow mask 86. In-process faceplate 108 is then removed from the production fixture 144 to "develop" the coating on the screening area. As a result of this first step, the grille that is formed on the screening area 112 has three open areas in correlation with each aperture of the shadow mask. In successive repetitions of the photoscreening process, the respective openings sequentially receive discrete deposits of green-light-emitting, blue-light-emitting, and red-light-emitting phosphors. For example, in the application of a green-light-emitting phosphor, the faceplate 108 is removed from production fixture 144 and the screening area 112 receives a coating of a slurry which contains a phosphor that emits green light when excited by an electron beam. The faceplate 108 is again placed in the production fixture 144 in precise registration with the in-process shadow mask 82, and the "green" phosphor coating is exposed to light projected through the apertures of the mask from a light source located at a position that corresponds to the emission point of the particular electron beam that is intended to excite the green-light-emitting phosphor. The light, in effect, "hardens" the phosphor so that it will remain in place during a subsequent washing process, and for the operating life of the tube. The steps are repeated for the application of the blue-light-emitting and red-light-emitting phosphors.

The registry of the pattern of phosphors and the shadow mask is accomplished according to the invention with a precison made possible by the use of the six-point precision indexing means, and the location of the patterns on the faceplate is made possible by the use of the a-b-c referencing of the faceplate and the faceplate locating fixture. The ball means or the groove means are, according to the invention, removably attached to the edges or sides of the faceplate.

Figure 2:
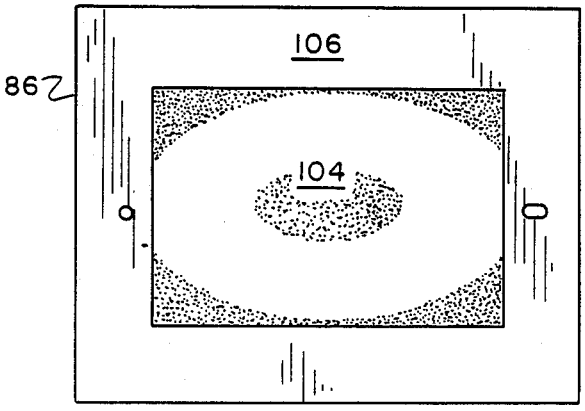
FIG. 2 is a plan view of an in-process foil shadow mask.

Upon completion of the screening process, the shadow mask 86 is permanently secured to the mask support structure 114 in permanent precise registration with the faceplate 108. The screened faceplate is replaced in production fixture 144 in conjunction with the mask 86, noted as being stretched in fixture 144. Fixture 144 then is installed in a mask welding and severing apparatus, using indexing means on the production apparatus that mates with production fixture 144. The welding is accomplished by laser beam, all as described in detail and claimed in referent copending application Ser. No. 058,095 of common ownership herewith. Severing of the mask to remove the unperforated section 106 indicated by FIG. 2 is also accomplished by laser beam; this severing produces a stand-alone faceplate-shadow mask assembly termed the "faceplate assembly."

Figure 11:
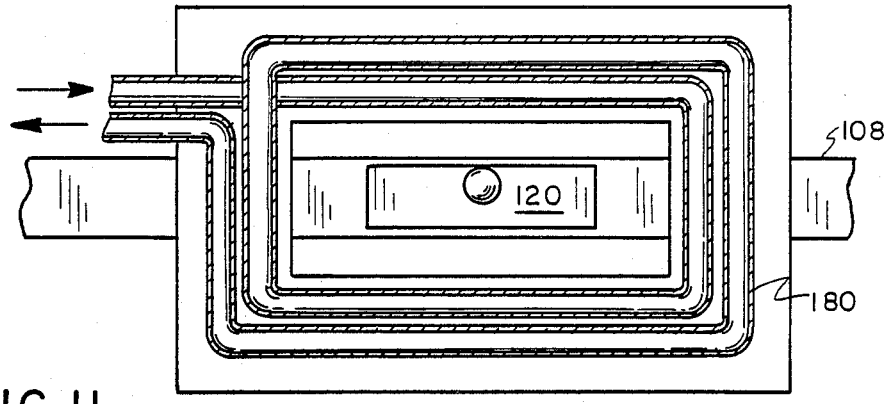
FIG. 11 is a diagrammatic view in elevation of a heating fixture used for removing the ball-plate indexing means shown by FIG. 6 from the sides of the faceplate.

The ball-plate indexing means 118, 119 and 120 are removed from faceplate 108 following the mask welding operation and prior to fritting of the funnel to the faceplate. Removal is preferably accomplished by mounting the faceplate in a suitable hold-down fixture, and subjecting each ball-plate indexing means to rapid, localized heating by radio-frequency induction. An r-f induction coil 180 is indicated is FIG. 11 as enclosing ball-plate indexing means 120 depicted as still attached to faceplate 108; one such coil is provided for each of the three ball-plate indexing means. Coil 180 is indicated as closely enclosing the ball-plate indexing means to concentrate the heat generated onto the means. The coil is preferably water cooled to prevent overheating and destruction of the coil; the flow of water is indicated schematically by the arrows. The rapid heat generated causes a quick deterioration of the adhesive with the result that the three ball-plate indexing means are released from the sides of the faceplate in about 5 seconds. Alternately, and if practicable, the ball-plate means may be left to remain attached to the faceplate with the presumption that they will fall off during a later high temperature cycle, such as the frit cycle, in which the temperature is typically 435 degrees C.

Following removal, the ball-plate indexing means 118, 119 and 120 must be cleaned before they can be re-used. The cleaning process removes not only the adhesive residues from the bonding surfaces but also byproducts of the screening and other processes such as dag and phosphor residues. The ball-plate indexing means are collected in baskets and first subjected to an oven bake-out at a temperature of 350 degrees C. for about 15 minutes, cooled, and immersed in an ultrasonic bath for about 10 minutes. The ultrasonic bath fluid is a standard solution used in cleaning faceplates prior to screening. Following the bath, the parts are rinsed and dried in a warm oven.

The final major step in the inventive process is the joining of the faceplate and the funnel. The faceplate is joined to the funnel using the faceplate and funnel a-b-c areas in conjunction with aligned a-b-c points on a funnel referencing and fritting fixture. As a result of the process according to the invention, the axis of the funnel is aligned with respect to the pattern of phosphors by the aligning of the a-b-c points on a funnel referencing and fritting fixture with the respective a-b-c reference areas on the faceplate and the funnel. The axis of the funnel is essentially the same as the tube axis 56 indicated by FIG. 1.

Figure 12:
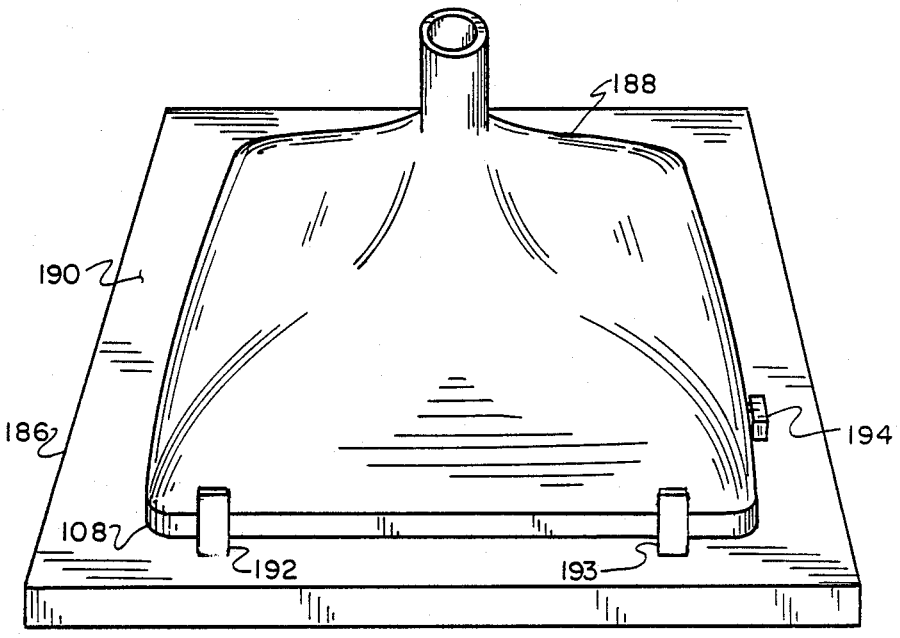
FIG. 12 is a perspective view of a funnel referencing and fritting fixture, with a funnel and the faceplate to which it is to be attached shown as being mounted on the fixture.
Figure 13:
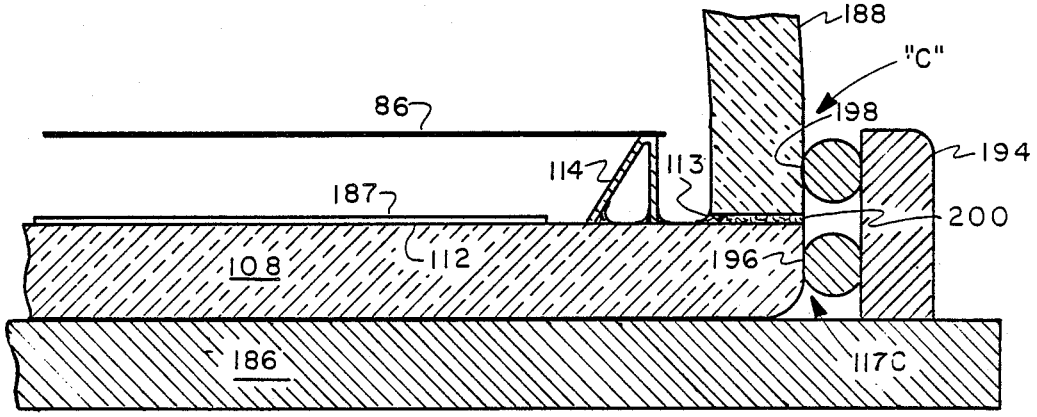
FIG. 13 is a detail view in section and in elevation depicting the fixture shown in FIG. 12, and its relationship to the funnel and faceplate.

With reference now to FIGS. 12 and 13, there is depicted a funnel reference and fritting fixture 186 on which faceplate 108 is indicated as being installed face down on the surface 190 of the fixture 186. A funnel 188 is depicted as being positioned thereon and in contact with funnel sealing surface 113 noted as being peripheral to screening area 112 on which is deposited a pattern of phosphors 187 as a result of the preceding screening operation. Funnel referencing and fritting fixture 186 is designed to be carried through an oven along with the faceplate and funnel for permanently attaching the funnel to the faceplate in what is called the "frit cycle." During the frit cycle, the funnel referencing and fritting fixture 186 and the components mounted thereon are exposed to a peak oven temperature of about 435 degrees C.

With reference to FIG. 12, three posts 192, 193 and 194 are indicated as providing support for the funnel and faceplate alignment means. In accord with the invention, funnel 188 has a-b-c areas located to be aligned with the a-b-c areas 117*a*, 117*b* and 117*c* on the faceplate 108. Posts 192, 193 and 194 have extending inwardly therfrom a-b-c points for registration with respective a-b-c areas on faceplate 108 and funnel 188.

FIG. 13 depicts details of interface between post 194, the faceplate 108 and funnel 188, and typical of the interfaces between posts 192 and 193 and the faceplate and the funnel. Flat 117*c* on faceplate 108 is shown in alignment with a reference area "c" on funnel 188. Shadow mask 86, noted as being in tension, is depicted as being mounted on shadow mask support structure 114; this configuration of a shadow mask support structure is the subject of U.S. Pat. No. 4,686,416 of common ownership herewith.

Post 194 is shown as having two reference points 196 and 198; reference point 196 fulfills the function of reference point 123*c* depicted in FIG. 4 in that it provides one of three reference points for locating the faceplate 108 in relation to the fixture on which it is mounted. The reference points preferably comprise buttons of carbon as they must be immune to the effects of the elevated oven temperature incurred during the frit cycle. Before the funnel 188 is placed in position on faceplate 108, a layer of frit 200 is applied to the funnel sealing surface 113. The frit may comprise Owens-Illinois frit CV-130, or an equivalent.

Using the respective a-b-c reference points on posts 192, 193 and 195 of the funnel referencing and fritting fixture 186, the funnel 188 is located with respect to funnel sealing area 113 and the pattern of phosphors 187, after which the funnel reference and fritting fixture 186 and the components installed thereon are subjected to the frit cycle, and exposed to a peak temperature of about 435 degrees C.

By this invention, a-b-c areas on the faceplate 108 and the funne) 188 are found and used to provide a relatively coarse but satisfactory referencing of those parts during frit seal, yet the precison referencing of the faceplate 108 and mask 86 needed to fabricate high-resolution cathode ray tubes is achieved through the use of the faceplate locating fixture 121, which establishes a temporary, but extremely precise six-point referencing system used during screen photodeposition and mask mounting. Since the faceplate precision indexing means is referenced to the faceplate a-b-c areas by means of the faceplate locating fixture 121, the phosphor pattern is located on the faceplate also with reference to the faceplate a-b-c areas. The funnel axis is referenced to the funnel a-b-c areas. Referencing of the funnel and faceplate a-b-c areas during frit seal thus references the funnel axis to the phosphor screen. (Two things referenced to a third are referenced to each other.)

While a particular embodiment of the invention has been shown and described, it will be readily apparent to those skilled in the art that changes and modifications may be made in the inventive process without departing from the invention in its broader aspects, and therefore, the aim of the appended claims is to cover all such changes and modifications as fall within the true spirit and scope of the invention.

What is claimed is:

1. For use in the manufacture of a color cathode ray tube having a rectangular flat faceplate, the process comprising:

positioning said faceplate in a predetermined x-y plane by referencing faceplate a-b-c reference areas on two adjacent edges or sides of the faceplate with complementary a-b-c reference points on a faceplate locating fixture which also has three spaced six-point precision indexing means;

with said faceplate a-b-c reference areas and said faceplate locating fixture a-b-c points mutually referenced, attaching to said faceplate six-point precision indexing means in registration with said precision indexing means on said faceplate locating fixture;

using said precision indexing means attached to said faceplate, registering a shadow mask with said faceplate through the use of complementary precision indexing means to provide a faceplate-shadow mask assembly in mutual precise registry;

with the use of the registered faceplate-shadow mask assembly, photodepositing a pattern of phosphors on said faceplate by photoexposure means, the registry of the pattern of phosphors and the shadow mask being accomplished with a precision made possible by the use of said six-point precision indexing means, and the location of said patterns on the faceplate being made possible by the use of the a-b-c referencing of said faceplate and said faceplate locating fixture.

2. The process according to claim 1 wherein said precision indexing means comprises the engaging of ball means with groove means.

3. The process according to claim 2 wherein said ball means or groove means are removably attached to the edges or sides of said faceplate.

4. The process according to claim 1 wherein said faceplate is mated with a production fixture holding a shadow mask by means of complementary six-point precision indexing means on said fixture in registry with said precision indexing means on said faceplate.

5. For use in the manufacture of a color cathode ray tube having a rectangular flat faceplate, the process comprising:

positioning said faceplate in a predetermined x-y plane by referencing faceplate a-b-c reference areas on two adjacent edges or sides of the faceplate with complementary a-b-c reference points on a faceplate locating fixture which also has three spaced six-point precision indexing means;

with said faceplate a-b-c reference areas and said faceplate locating fixture a-b-c points mutually referenced, adhering to said the edges or sides of said faceplate removable six-point precision indexing means in registration with said precision indexing means on said faceplate locating fixture;

using said six-point precision indexing means adhered to said faceplate, registering a shadow mask with said faceplate through the use of complementary precision indexing means to provide a faceplate-shadow mask assembly in mutual precise registry;

with the use of the registered faceplate-shadow mask assembly, photodepositing a pattern of phosphors on said faceplate by photoexposure means, removing said removable six-point indexing means from said faceplate;

such that the registry of the pattern of phosphors and the shadow mask is accomplished with a precision made possible by the use of said six-point precision indexing means, and the location of said patterns on the faceplate is made possible by the use of the a-b-c referencing of said faceplate and said faceplate locating fixture.

6. For use in the manufacture of a color cathode ray tube having a rectangular flat faceplate, the process comprising:

positioning said faceplate in a predetermined x-y plane by referencing three a-b-c reference areas on two adjacent edges or sides of the faceplate with complementary a-b-c reference points on a faceplate locating fixture which also has three spaced precision six-point indexing means;

with said faceplate a-b-c reference areas and said faceplate locating fixture a-b-c points mutually referenced, attaching to said faceplate, six-point precision indexing means in registration with said precision indexing means on said faceplate locating fixture;

using said precision faceplate indexing means, registering a shadow mask with said faceplate through the use of complementary precision indexing means to provide a faceplate-shadow mask assembly in mutual precise registry;

with the use of the registered faceplate-shadow mask assembly, photodepositing a pattern of phosphors on said faceplate by photoexposure means, the registry of the pattern of phosphors and the apertures of the shadow mask being accomplished with a precision made possible by the use of said six-point precision indexing means, and the location of said pattern on said faceplate being made possible by the use of the a-b-c-referencing of said faceplate and said faceplate locating fixture;

providing a funnel having a-b-c reference areas located to be aligned with said a-b-c reference areas on said faceplate;

joining said faceplate to said funnel using said faceplate and funnel a-b-c areas in conjunction with aligned a-b-c points on a funnel referencing and fritting fixture, whereby the axis of said funnel is aligned with respect to said pattern of phosphors by the aligning of said a-b-c points on said funnel referencing and fritting fixture with the a-b-c reference areas on said faceplate and said funnel.

7. For use in the manufacture of a color cathode ray tube having a rectangular flat faceplate with a centrally located phosphor screening area, and a funnel sealing surface peripheral to said screening area, the process comprising:

securing a frame-like shadow mask support structure to said faceplate between said screening area and said funnel sealing surface to provide a surface for receiving and mounting a foil shadow mask a Q-distance from said screening area;

positioning said faceplate in a predetermined x-y plane by referencing faceplate a-b-c reference areas on two adjacent edges or sides of the faceplate with complementary a-b-c reference points on a faceplate locating fixture which also has three spaced six-point precision indexing means;

with said faceplate a-b-c reference areas and said faceplate locating fixture a-b-c points mutually referenced, attaching to said faceplate temporary six-point precision indexing means in registration with said precision indexing means on said faceplate locating fixture;

providing a frame-like production fixture having precision indexing means for registering with said precision indexing means on said faceplate;

mounting a foil shadow mask on said fixture under tension and bringing with said mask into contact with said mask support structure on said faceplate and in mutual precision registry with said screening area of said faceplate using said precision indexing means on said faceplate and said fixture;

photodepositing a pattern of phosphors on said faceplate, including a photoexposure step performed in a lighthouse with said faceplate and mask in mutual registry;

permanently securing said mask to said mask support structure in permanent precise registration with said faceplate;

removing from said faceplate said temporary six-point precision indexing means;

providing a funnel having a-b-c areas located to be aligned with said a-b-c reference areas on said faceplate;

joining said faceplate to said funnel using said faceplate and funnel a-b-c areas in conjunction with aligned a-b-c points on a funnel referencing and fritting fixture, whereby the axis of said funnel is aligned with respect to said pattern of phosphors by the aligning of said a-b-c points on said funnel referencing and fritting fixture with the a-b-c reference areas on said faceplate and said funnel.

8. For use in the manufacture of a color cathode ray tube having a rectangular flat faceplate, a process for indexing the faceplate with other components, comprising:

positioning said faceplate in a predetermined x-y plane by referencing faceplate a-b-c reference areas on two adjacent edges or sides of the faceplate with complementary a-b-c reference points on a faceplate locating fixture which also has three spaced precision two-point ball-groove means;

with said faceplate a-b-c areas and said faceplate locating fixture a-b-c points mutually referenced, removably adhering to the edges or sides of said faceplate temporary precision six-point ball-groove indexing means in registration with and complementary to said precision ball-groove means on said faceplate locating fixture;

whereby said faceplate can be registered with an associated shadow mask and funnel with a precision made possible by the use of said precision faceplate and fixture ball-groove means, and said faceplate ball-groove means can be removed when the registrations are completed.

9. The process according to claim 8 wherein said faceplate ball-groove means are temporarily adhered to said faceplate by thermally degradable adhesive means.

10. The process according to claim 9 wherein said thermally degradable adhesive means comprises a methacrylic adhesive.

11. The process according to claim 9 wherein the adherence of said ball means is hastened by the pre-application to the adhering surfaces of an activator comprising a butyraldehyde condensation product.

12. The process according to claim 10 wherein the adherence of said methacrylic adhesive is hastened by exposure to ultraviolet light.

13. The process according to claim 10 wherein said ball means are removed from said faceplate by heating said methacrylic adhesive.

* * * * *